US006039264A

United States Patent [19]

Okabe et al.

[11] Patent Number: 6,039,264

[45] Date of Patent: Mar. 21, 2000

[54] VISCOUS FLUID TYPE HEAT GENERATOR

[75] Inventors: Takanori Okabe; Takashi Ban; Shigeru Suzuki; Tatsuya Hirose, all of Kariya, Japan

[73] Assignee: Kabushiki Kaisha Toyoda Jidoshokki Seisakusho, Japan

[21] Appl. No.: 09/129,693

[22] Filed: Aug. 5, 1998

[30] Foreign Application Priority Data

Aug. 7, 1997 [JP] Japan ..... 9-213580

[51] Int. Cl.[7] ..... B60H 1/02

[52] U.S. Cl. ..... 237/12.3 R; 237/12.3 B; 122/26; 126/247

[58] Field of Search ..... 237/12.3 R, 12.3 B; 122/26; 126/247; 123/142.5 R

[56] References Cited

U.S. PATENT DOCUMENTS 5,573,184 11/1996 Martin ..... 237/12.3 R

FOREIGN PATENT DOCUMENTS 8-337110 12/1996 Japan .

*Primary Examiner*—Henry Bennett
*Assistant Examiner*—Derek Boles
*Attorney, Agent, or Firm*—Woodcock Washburn Kurtz Mackiewicz & Norris LLP

[57] ABSTRACT

A viscous fluid type heat generator including a housing assembly defining therein a heat generating chamber and a heat receiving chamber, a drive shaft rotatably supported by the housing assembly, a rotor element mounted to be rotationally driven by the drive shaft for rotation within the heat generating chamber, and a viscous fluid, held in a gap defined between the inner wall surfaces of the heat generating chamber and the outer surfaces of the rotor element, for heat generation under shearing stress applied by the rotation of the rotor element. At least a part of the housing assembly, which defines the heat generating chamber, is made of a material of which a linear expansion coefficient is larger than that of a material of the rotor element.

7 Claims, 4 Drawing Sheets

VISCOUS FLUID TYPE HEAT GENERATOR

BACKGROUND OF THE INVENTION

1. Field of the Invention

The present invention relates to a viscous fluid type heat generator which includes a housing provided with a heat generating chamber and a heat receiving chamber separated from each other, and a rotor element for shearing a viscous fluid contained in the heat generating chamber to generate heat that is in turn transmitted to a heat exchanging fluid circulating through the heat receiving chamber to be carried by the heat exchanging fluid to a desired area to be heated.

2. Description of the Related Art

A viscous fluid type heat generator which may be incorporated in a vehicle heating system is known in the art, and one example is disclosed in Japanese Unexamined Patent Publication (Kokai) No. 8-337110 (JP-A-8-337110). In this viscous fluid type heat generator, a housing assembly defines therein a heat generating chamber and a heat receiving chamber arranged adjacent to the heat generating chamber. The heat generating chamber is isolated from the heat receiving chamber by a partition wall through which heat is exchanged between a viscous fluid accommodated in the heat generating chamber and a heat exchanging fluid flowing through the heat receiving chamber. The heat exchanging fluid is introduced through an inlet port into the heat receiving chamber, and is delivered through an outlet port from the heat receiving chamber to an external heating circuit.

A drive shaft is supported for rotation by a bearing unit in the housing assembly and sealed by a sealing device therein. A rotor element, which may be made of a plastic material, is fixedly mounted on the drive shaft at the rear end thereof in such a manner as to be able to rotate within the heat generating chamber. An electromagnetic clutch is provided on the drive shaft at the front end thereof to transmit the output torque of a vehicle engine to the drive shaft through the clutch. The rotor element includes outer surfaces arranged face-to-face with the inner wall surfaces of the heat generating chamber to define therebetween a fluid-tight gap. The viscous fluid is supplied into the heat generating chamber to be held in the fluid-tight gap.

When the output torque of the vehicle engine is transmitted through the electromagnetic clutch to the drive shaft to rotationally drive the drive shaft, the rotor element is also rotated within the heat generating chamber. At this time, the rotating rotor element applies a shearing stress to the viscous fluid held in the gap between the inner wall surfaces of the heat generating chamber and the outer surfaces of the rotor element, and thereby the viscous fluid generates heat. The generated heat is then transmitted from the viscous fluid to the heat exchanging fluid circulating through the heat receiving chamber, and the heat exchanging fluid carries the transmitted heat to the heating circuit of the vehicle heating system to heat a passenger compartment.

In the conventional viscous fluid type heat generators, it is generally difficult to ensure both the large amount of heat generation and the durability of the components of the generator.

That is, to ensure the large amount of heat generation in this type of heat generator, it is desired that the fluid-tight gap between the inner wall surfaces of the heat generating chamber and the outer surfaces of the rotor element is small. However, when the rotor element continuously rotates after it starts for rotation, the temperature of the viscous fluid rises to a high level due to the heat generation thereof, and thereby, parts of the housing assembly, which constitute the walls of the heat generating chamber, as well as the rotor element expand due to the temperature rise, to a significant extent.

Consequently, there are some cases where the dimension of the fluid-tight gap is further reduced, though the cases depend on the selection of materials of the chamber wall parts of the housing assembly and the rotor element, and where the reduced gap causes an interference or a frictional sliding between the chamber wall part and the rotor element. Also, in such cases, even if the passenger compartment has been sufficiently or satisfactorily heated, the viscous fluid continuously and increasingly generates heat, which may result in heat and/or mechanical deterioration of the components of the heat generator.

Particularly, when the conventional heat generator, as described in JP-A-8-337110, includes a plastic rotor element and a metal housing assembly, in consideration of the heat resistance of the housing assembly, the durability of the components of the generator may be deteriorated because the thermal expansion coefficient of plastic material is normally larger than that of metal. Further, when this heat generator is incorporated in the vehicle heating system, the vehicle engine frequently drives the drive shaft at a high speed of rotation, e.g., thousands of r.p.m., and thereby the viscous fluid may generate heat at a temperature of several hundreds of degrees (° C.). Consequently, if the rotor element is made of plastic materials, the rotor element in itself tends to have low heat resistance.

SUMMARY OF THE INVENTION

It is, therefore, an object of the present invention to provide a viscous fluid type heat generator which can ensure both the large amount of heat generation and the good durability of the components of the generator.

In accordance with the present invention, there is provided a viscous fluid type heat generator comprising a housing assembly defining therein a heat generating chamber in which heat is generated, the heat generating chamber having inner wall surfaces thereof, and a heat receiving chamber arranged adjacent to the heat generating chamber, the heat receiving chamber permitting a heat exchanging fluid to circulate through the heat receiving chamber to thereby receive heat transferred from the heat generating chamber; a drive shaft supported by the housing assembly to be rotatable about an axis of rotation of the drive shaft, the drive shaft being operationally connected to an external rotation-drive source; a rotor element mounted to be rotationally driven by the drive shaft for rotation within the heat generating chamber, the rotor element having outer surfaces confronting the inner wall surfaces of the heat generating chamber via a gap defined therebetween; and a viscous fluid, held in the gap defined between the inner wall surfaces of the heat generating chamber and the outer surfaces of the rotor element, for heat generation when a shearing stress is applied by the rotation of the rotor element; wherein at least a part of the housing assembly, which defines the heat generating chamber, is made of a material of which a linear expansion coefficient is larger than that of a material of the rotor element.

In this viscous fluid type heat generator, the housing assembly may include at least one partition plate arranged between the heat generating chamber and the heat receiving chamber, the partition plate having the inner wall surfaces of the heat generating chamber, and the partition plate may be made of the material of which the linear expansion coefficient is larger than that of the material of the rotor element.

Alternatively, the housing assembly may include at least one partition plate arranged between the heat generating chamber and the heat receiving chamber, the partition plate having the inner wall surfaces of the heat generating chamber, and at least one housing body arranged outside of the partition plate to define the heat receiving chamber between the housing body and the partition plate, and the partition plate and the housing body may be made of the material of which the linear expansion coefficient is larger than that of the material of the rotor element.

It is advantageous that the material of the at least a part of the housing assembly is an aluminum material.

In this case, the aluminum material may be a die-cast aluminum having a linear expansion coefficient of $2.10\times10^{-5}$ (1/K).

It is also advantageous that the material of the rotor element is a ferrous material.

In this case, the ferrous material may be a medium carbon steel having a linear expansion coefficient of $1.17\times10^{-5}$ (1/K).

BRIEF DESCRIPTION OF THE DRAWINGS

The above and other objects, features and advantages of the present invention will become more apparent from the following description of preferred embodiments in connection with the accompanying drawings, in which.

DETAILED DESCRIPTION OF THE PREFERRED EMBODIMENTS

Figure 1:
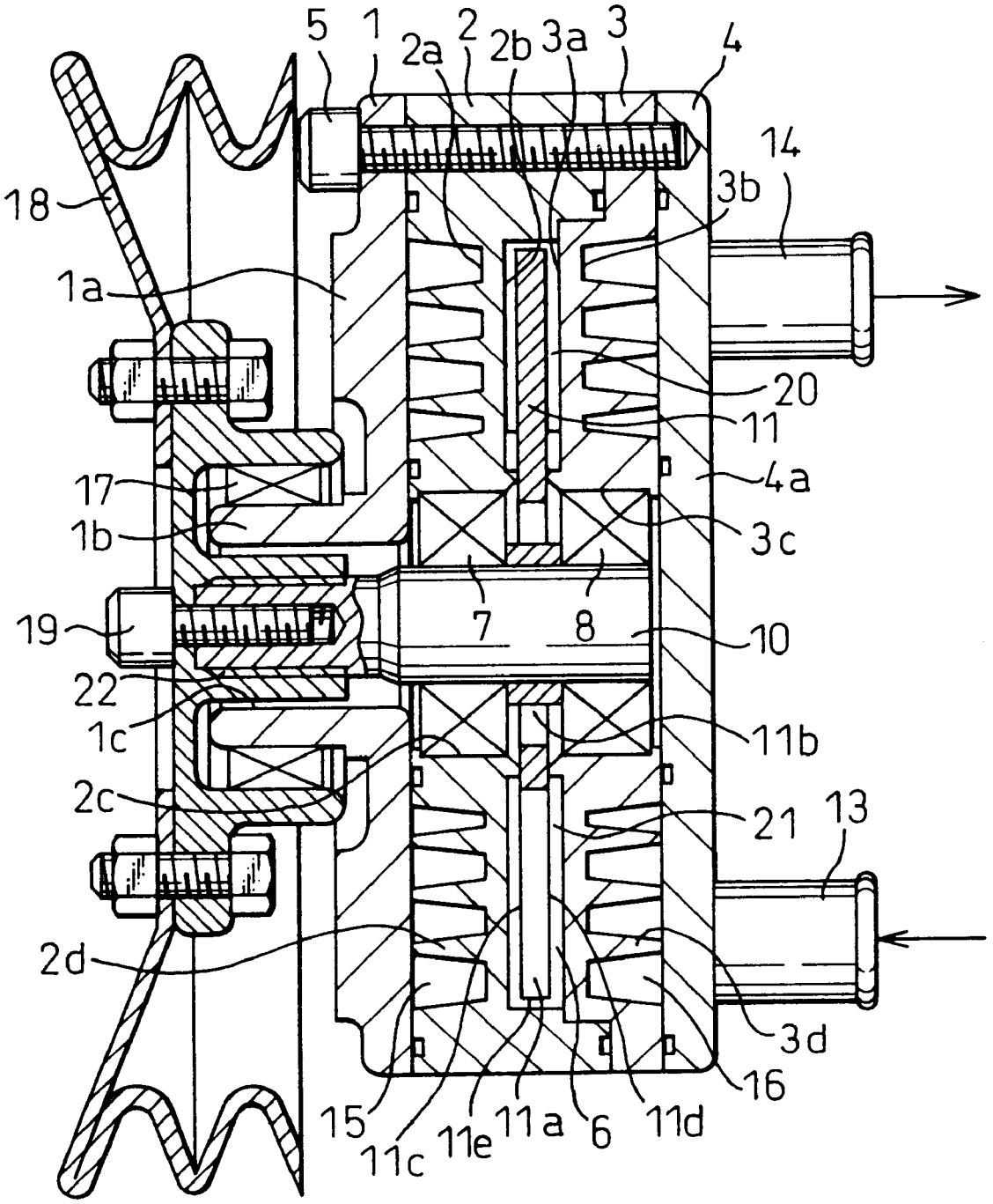
FIG. 1 is a vertical sectional view of one embodiment of a viscous fluid type heat generator according to the present invention.

Referring now to the drawings, wherein the same or similar components are designated by the same reference numerals, FIG. 1 shows one embodiment of a viscous fluid type heat generator according to the present invention. The viscous fluid type heat generator of this embodiment may be used as a supplementary heat source incorporated in a vehicle heating system, but may be embodied in other applications.

The heat generator of this embodiment includes a front housing body 1, a front partition plate 2, a rear partition plate 3 and a rear housing body 4. The front and rear partition plates 2, 3 are stacked with each other through the interposition of an O-ring hermetically sealing between the outer peripheral regions of the mutually opposed surfaces of the partition plates 2, 3. The stacked front and rear partition plates 2, 3 are securely and tightly held between the front and rear housing bodies 1, 4 through the interposition of plural O-rings. The O-rings are arranged to hermetically seal between the inner and outer peripheral regions of the front housing body 1 and the front partition plate 2, as well as between the inner and outer peripheral regions of the rear housing body 4 and the rear partition plate 3, respectively. The front and rear housing bodies 1, 4 and the front and rear partition plates 2, 3, thus stacked, are axially and tightly combined by a plurality of screw bolts 5 (only one bolt 5 is shown in FIG. 1) to form a housing assembly of the heat generator.

The front housing body 1 includes a flat annular plate section 1*a* and a center boss 1*b* axially frontwardly and integrally extending from the radially inner edge of the annular plate section 1*a* to define therein a center through bore 1*c*. The rear housing body 4 includes a flat plate section 4*a* and inlet and outlet ports 13, 14 rearwardly and integrally extending from the flat plate section 4*a*. The ports 13, 14 are described in more detail below.

The front partition plate 2 includes axially opposed front and rear surfaces 2*a*, 2*b* and a center through hole 2*c*. The rear partition plate 3 includes axially opposed front and rear surfaces 3*a*, 3*b* and a center through hole 3*c*. The rear surface 2*b* of the front partition plate 2 defines an annular recess thereon. A flat annular rear surface part and a cylindrical circumferential surface part of the annular recess formed in the rear surface 2*b* of the front partition plate 2 cooperate with the flat annular front surface part of the front surface 3*a* of the rear partition plate 3 to define a heat generating chamber 6. Thus, the rear surface part and circumferential surface part of the rear surface 2*b* as well as the front surface part of the front surface 3*a* constitute the inner wall surfaces of the heat generating chamber 6.

The front surface 2*a* of the front partition plate 2 defines an annular recess thereon, and three C-shaped ridges 2*d* axially frontwardly projecting and concentrically extending around the center through hole 2*c* are provided in the annular recess. The surface part of the front surface 2*a* of the front partition plate 2, involving the surfaces of annular recess and C-shaped ridges 2*d*, cooperates with a flat rear surface of the annular plate section 1*a* of the front housing body 1 to define a C-shaped front heat receiving chamber 15 arranged near the front side of the heat generating chamber 6. The front heat receiving chamber 15 is separated in a fluid-tight manner from the heat generating chamber 6 by the front partition plate 2 interposed therebetween.

The rear surface 3*b* of the rear partition plate 3 defines an annular recess thereon, and three C-shaped ridges 3*d* axially rearwardly projecting and concentrically extending around the center through hole 3*c* are provided in the annular recess. The surface part of the rear surface 3*b* of the rear partition plate 3, involving the surfaces of the annular recess and the C-shaped ridges 3*d*, cooperates with a flat front surface of the plate section 4*a* of the rear housing body 4 to define a C-shaped rear heat receiving chamber 16 arranged near the rear side of the heat generating chamber 6. The rear heat receiving chamber 16 is separated in a fluid-tight manner from the heat generating chamber 6 by the rear partition plate 3 interposed therebetween.

The inlet port 13 formed on the rear housing body 4 communicates with the front and rear heat receiving chambers 15, 16 through channels (not shown) formed respectively in the front and rear partition plates 2, 3 and the rear housing body 4. Also, the outlet port 14 formed on the rear housing body 4 communicates with the front and rear heat receiving chambers 15, 16 through the other channels (not shown) formed respectively in the front and rear partition plates 2, 3 and the rear housing body 4.

Heat exchanging fluid circulating through the heating circuit (not shown) of the vehicle heating system is introduced through the inlet port 13 into the front and rear heat receiving chambers 15, 16, flows along substantially circular passages defined by the annular ridges 2*d*, 3*d* in the front and rear heat receiving chambers 15, 16, and is discharged from the front and rear heat receiving chambers 15, 16 through the outlet port 14 into the heating circuit. The annular ridges 2*d*, 3*d* serve to increase heat exchanging surface areas between the heat exchanging fluid and the front and rear partition plates 2, 3.

A drive shaft 10, typically positioned in a substantially horizontal state, extends in the center through bore 1*c* of the front housing body 1 and the center through holes 2*c*, 3*c* of the front and rear partition plates 2, 3, and is supported for rotation by a bearing units 7, 8 respectively mounted in the center through holes 2*c*, 3*c*. Both the bearing units 7, 8 are provided with shaft sealing means (not shown). Consequently, the heat generating chamber 6 is sealed in a fluid-tight manner from the exterior of the heat generator.

A rotor element 11 in the shape of flat circular disk is fixedly mounted or press fitted onto the drive shaft 10 at a location between the bearing units 7, 8, and is arranged within the heat generating chamber 6 for rotation together with the drive shaft 10. The rotor element 11 has axially opposed front and rear annular surfaces 11*c*, 11*d* and an outer circumferential surface 11*e*, which constitute the outer surfaces of the rotor element 11. The outer surfaces of the rotor element 11 do not come into contact with the inner wall surfaces of the heat generating chamber 6 at any time, and thus define therebetween a relatively small fluid-tight gap 20 for holding a viscous fluid 21 as described later.

Figure 3:
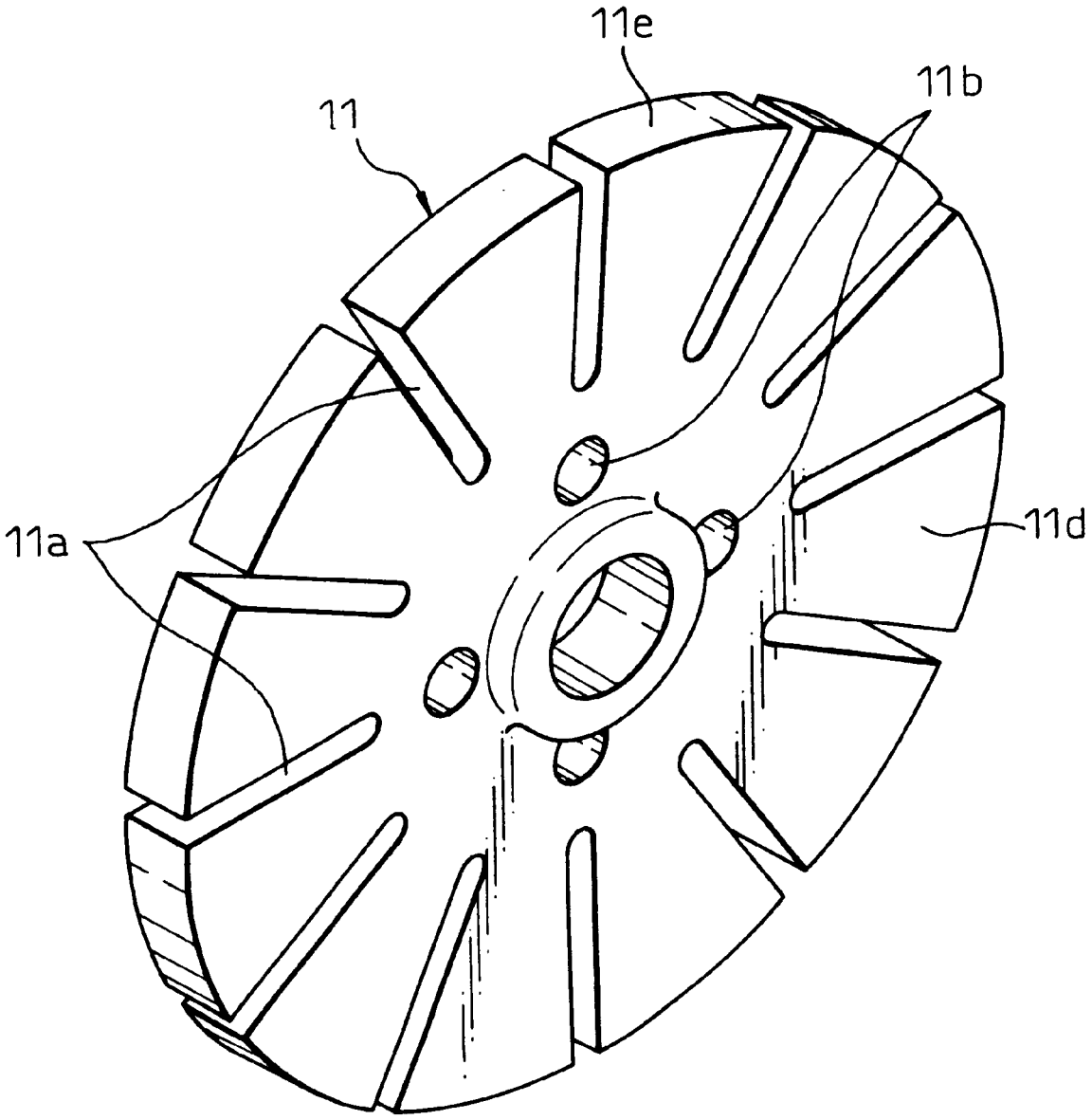
FIG. 3 is a perspective view of a rotor element incorporated in the heat generator of FIG. 1.

As shown in FIG. 3, the rotor element 11 is provided with a plurality of radial slits 11*a*, each of which extends between the front, rear and circumferential surfaces of the rotor element 11. The slits 11*a* serve to enhance the shearing effect for the viscous fluid 21 due to the rotating rotor element 11, and also serve to facilitate the radial displacement of the viscous fluid 21 held in the fluid-tight gap 20 toward the outer peripheral region thereof when the rotor element 11 rotates. The rotor element 11 is also provided with a plurality of through holes 11*b* formed in the radially inner region of the rotor element 11. Each through hole 11*b* extends between the front and rear surfaces of the rotor element 11 to communicate the front and rear side of the latter.

The viscous fluid 21, such as silicone oil, is enclosed within the fluid-tight gap 20 in the heat generating chamber 6 at an amount of approximately 40 to 70 volume percent.

In the viscous fluid type heat generator of the present invention, at least a part of a housing assembly, which defines a heat generating chamber, is made of a material of which a linear expansion coefficient is larger than that of a material of a rotor element. In the illustrated embodiment, the housing assembly, formed by the front housing body 1, the front partition plate 2, the rear partition plate 3 and the rear housing body 4, is entirely made of an aluminum material, i.e., a die-cast aluminum (JIS/ADC12) having a linear expansion coefficient of $2.10\times10^{-5}$ (1/K). On the other hand, the rotor element 11 is made of a ferrous material, i.e., a medium carbon steel (JIS/S45C) having a linear expansion coefficient of $1.17\times10^{-5}$ (1/K).

A pulley 18 is rotatably supported through a bearing unit 17 on the center boss 1*b* of the front housing body 1, and is fixedly mounted on the drive shaft 10 at the front end of the latter through a bolt 19 and a spline 22. The pulley 18 is operatively connected by a belt (not shown) to a vehicle engine (not shown) as a drive source. It will be appreciated that the drive shaft 10 may be connected through a known electromagnetic clutch to the vehicle engine, instead of the pulley 18.

In the viscous fluid type heat generator of the above embodiment, when the drive shaft 10 is driven by the vehicle engine, the rotor element 11 is rotated within the heat generating chamber 6. Therefore, the viscous fluid 21 such as silicone oil held in the fluid-tight gap 20 between the inner wall surfaces of the heat generating chamber 6 and the outer surfaces of the rotor element 11 is subjected to a shearing stress by the rotating rotor element 11. Consequently, the viscous fluid 21 generates heat, which is transferred to the heat exchanging fluid, typically water, flowing through the front and rear heat receiving chambers 15, 16. Then, the heat is carried by the heat exchanging fluid to a heating circuit of the heating system to warm an objective area of the vehicle, such as a passenger compartment or the engine.

When the rotor element 11 continuously rotates for a long time, and the temperature of the viscous fluid 21 rises to a high level due to the heat generation therein, the front and rear partition plates 2, 3, which constitute the walls of the heat generating chamber 6, as well as the rotor element 11 expand under the temperature rise to a significant extent. In this situation, since the front and rear partition plates 2, 3 are made of a die-cast aluminum having a linear expansion coefficient of $2.10\times10^{-5}$ (1/K), and the rotor element 11 is made of a medium carbon steel having a linear expansion coefficient of $1.17\times10^{-5}$ (1/K), the front and rear partition plate 2, 3 thermally expand to a larger extent than the rotor element 11.

Consequently, in the viscous fluid type heat generator of the above embodiment, even if the rotor element 11 continuously rotates for a long time, the dimension of the fluid-tight gap 20 is prevented from being reduced, and the gap 20 is enlarged due to the temperature rise of the viscous fluid 21. Therefore, an interference or a frictional sliding between the front and rear partition plate 2, 3 and the rotor element 11 is effectively prevented. If the passenger compartment has been sufficiently or satisfactorily heated when the front and rear partition plates 2, 3 and the rotor element 11 expand, the fluid-tight gap 20 holding the viscous fluid 21 therein has been enlarged, so that the shearing stress applied to the viscous fluid 21 is reduced to suppress the excessive heat generation of the viscous fluid 21. Accordingly, heat and/or mechanical deterioration of the components of the heat generator is effectively prevented.

Figure 2:
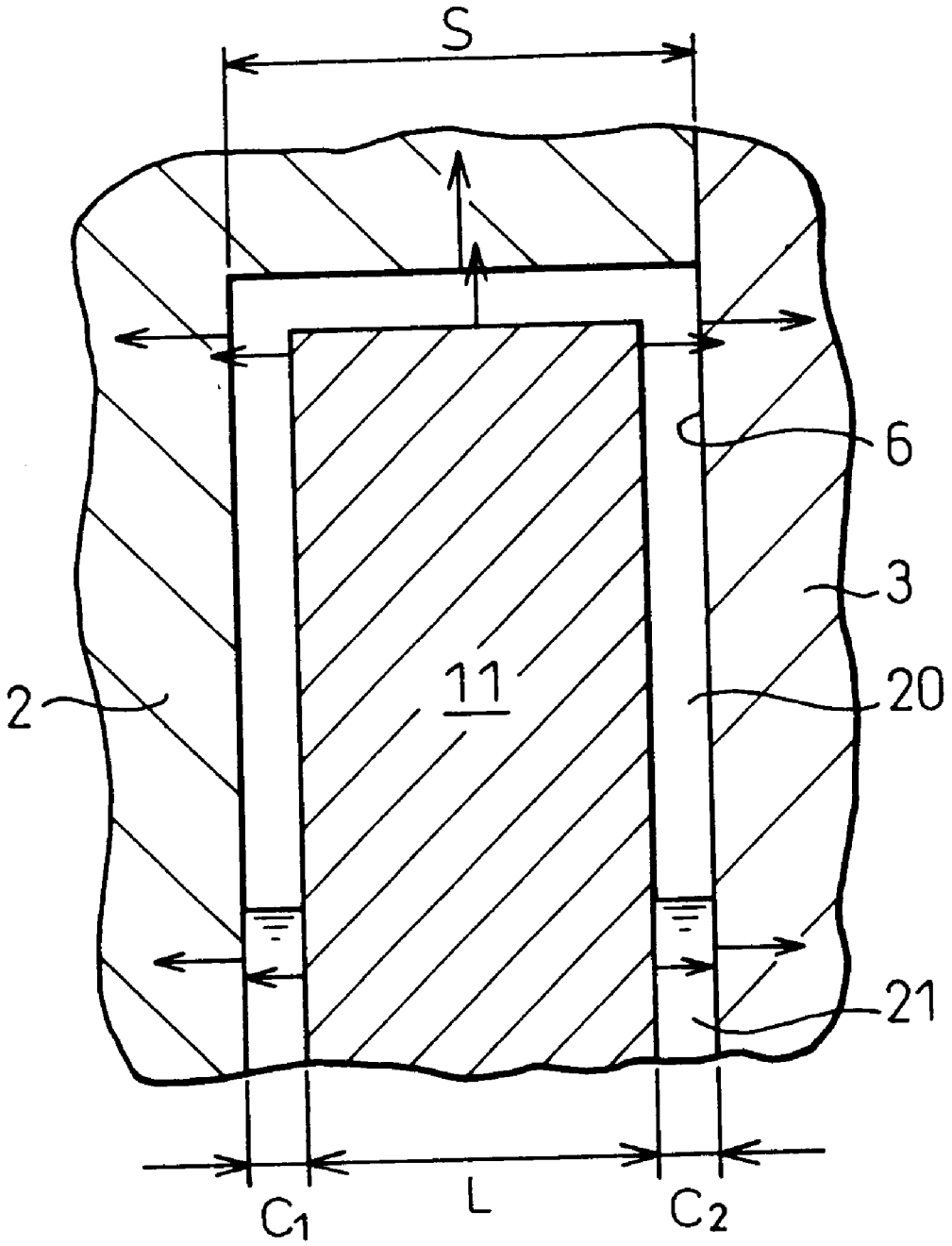
FIG. 2 is an enlarged sectional view of a part of the heat generator of FIG. 1.

Especially, in the above heat generator, the rotor element 11 is shaped as a circular disk, and thus the peripheral velocity or rotating speed of the rotor element 11 is larger in the radially outer portion thereof than that in the radially inner portion thereof, so that the heat generation of the viscous fluid 21 is larger in the radially outer region of the gap 20 than that in the radially inner region of the gap 20. Consequently, the difference between the expanded length of the front partition plate 2 and that of the rotor element 11 is larger in the radially outer portions thereof than that in the radially inner portions thereof (as shown by arrows in FIG. 2), whereby the fluid-tight gap 20 is enlarged to a relatively large extent in the radially outer region thereof in which the viscous fluid 21 tends to be subjected to a relatively high shearing stress.

Accordingly, the dimension of the fluid-tight gap 20 in above heat generator can be reduced to such an extent that the large amount of heat generation is stably obtained, while the durability of the components of the generator, especially of the front and rear partition plates 2, 3 and the rotor element 11, is ensured.

Experiment

Suppose that, in the viscous fluid type heat generator of the above embodiment, the annular recess of the front partition plate 2, which defines the heat generating chamber 6 in cooperation with the rear partition plate 3, has a depth S=5.2 mm, the rotor element 11 has a thickness L=5.0 mm, and the fluid-tight gap 20 has a front distance $C_1$=0.1 mm and a rear distance $C_2$=0.1 mm (see FIG. 2), at the ordinary temperature 20° C. of the ambient atmosphere when the heat generator is assembled. The front and rear partition plates 2, 3 are made of a die-cast aluminum (JIS/ADC12) having a linear expansion coefficient $\beta_2=2.10\times10^{-5}$ (1/K), and the rotor element 11 is made of a medium carbon steel (JIS/S45C) having a linear expansion coefficient $\beta_1=1.17\times10^{-5}$ (1/K).

On the other hand, a comparison viscous fluid type heat generator includes the same structure and dimension as the above embodiment except that both the rotor element 11 and the front and rear partition plates 2, 3 are made of a die-cast aluminum (JIS/ADC12) having a linear expansion coefficient $\beta_2=2.10\times10^{-5}$ (1/K).

If the temperature of the viscous fluid 21 rises from 20° C. to t° C., the dimensions of $C_1(t)$ and $C_2(t)$ increased due to the temperature rise are calculated by equations as follows:

(embodiment)

$$C_1(t)=C_2(t)=[\{S+\beta_2S(t-20)\}-\{L+\beta_1L(t-20)\}]\times½ \quad (1)$$

(comparison)

$$C_1(t)=C_2(t)=[\{S+\beta_2S(t-20)\}-\{L+\beta_2L(t-20)\}]\times½ \quad (2)$$

The theoretical heating value Q (cal) of the viscous fluid 21 held in the front and rear gap portions of the fluid-tight gap 20 is calculated by an equation as follows:

$$Q = 2\int_0^{r0} 2\pi r^2 (r\omega / C_1)\mu dl\, r \times \omega = \pi r_0^4 \mu\omega^2 (1/C_1) \quad (3)$$

wherein $\mu$ is a viscosity (poise) of the viscous fluid 21, ω is an angular velocity (rad/sec) of the rotor element 11, and $r_0$ is a radius (mm) of the rotor element 11.

As will be understood from the equations (1) and (2), the dimension of $C_1(t)$ (or $C_2(t)$) in the heat generator of the above embodiment is larger than that of the comparative heat generator. Further, as will be understood from the equation (3), the theoretical heating value Q(t) at the temperature t° C. is in an inverse proportion to $C_1(t)$ (or $C_2(t)$). Therefore, it can be seen that the heat generator of the above embodiment suppresses the excess heat generation of the viscous fluid 21 at a high temperature, by increasing the dimension of the fluid-tight gap 20, in comparison with the comparative heat generator.

Figure 4:
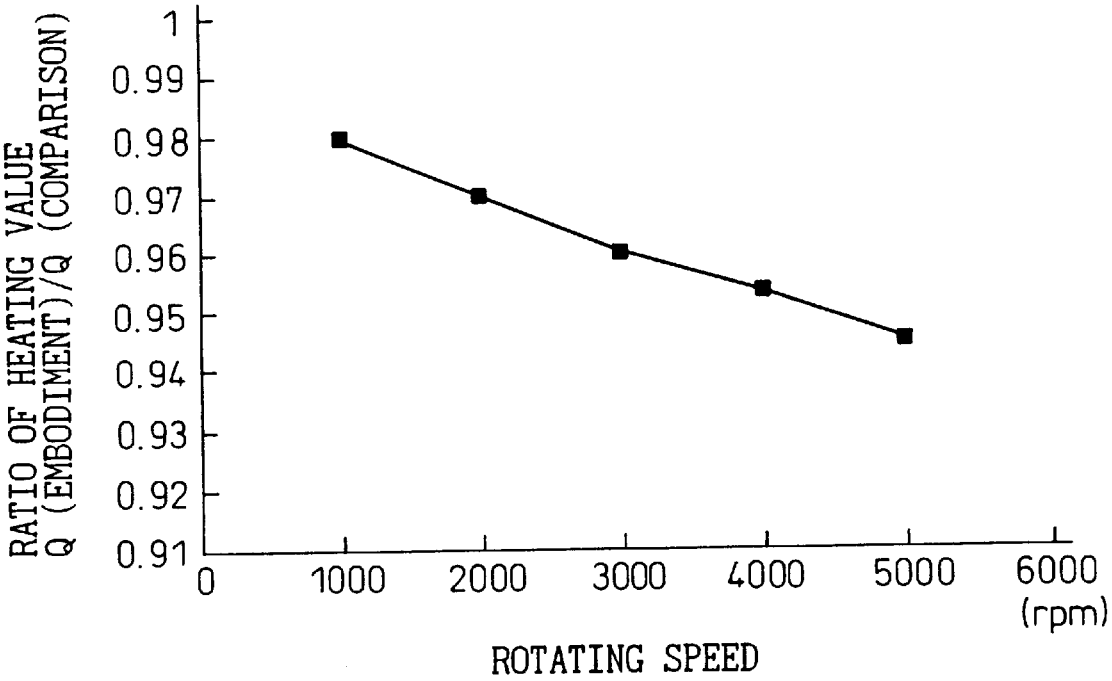
FIG. 4 illustrates a relationship between the rotating speed of a drive shaft and a heating value ratio of the embodiment to a comparison example.

FIG. 4 illustrates the relationship between the rotating speed of the drive shaft 10 or the rotor element 11 and the ratio of a theoretical heating value Q(t) of the embodiment to that of the comparison, obtained as a result of an experiment. As will be understood from FIG. 4, the heat generator of the above embodiment suppresses the excess heat generation of the viscous fluid 21 at a high rotating speed of the rotor element 11, i.e., at a high temperature, in comparison with the comparative heat generator.

The above estimation does not consider the increase of the circumferential gap portion of the fluid-tight gap 20 due to the temperature rise, since the rotor element 11 has a circular disk shape and thus the volume of the circumferential gap portion may not be significantly increased. However, it will be appreciated that, when the rotor element having a cylindrical shape is incorporated, the increase in the circumferential gap portion becomes significant.

While the invention has been particularly shown and described with reference to preferred embodiments thereof, it will be understood by those skilled in the art that various changes and modifications may be made without departing from the spirit and scope of the invention. For example, the housing assembly having the different structure may be employed, in which only the front and rear partition plates 2, 3 are made of the die-cast aluminum (JIS/ADC12) having a linear expansion coefficient of $2.10\times10^{-5}$ (1/K) and the front and rear housing body 1, 4 are made of the other material, such as a medium carbon steel (JIS/S45C) having a linear expansion coefficient of $1.17\times10^{-5}$ (1/K). In any case, the scope of the invention is therefore to be determined solely by the appended claims.

We claim:

1. A viscous fluid type heat generator comprising:

a housing assembly defining therein a heat generating chamber in which heat is generated, said heat generating chamber having inner wall surfaces thereof, and a heat receiving chamber arranged adjacent to said heat generating chamber, said heat receiving chamber permitting a heat exchanging fluid to circulate through said heat receiving chamber to thereby receive heat transferred from said heat generating chamber;

a drive shaft supported by said housing assembly to be rotatable about an axis of rotation of said drive shaft, said drive shaft being operationally connected to an external rotation-drive source;

a rotor element mounted to be rotationally driven by said drive shaft for rotation within said heat generating chamber, said rotor element having outer surfaces confronting said inner wall surfaces of said heat generating chamber via a gap defined therebetween; and a viscous fluid, held in said gap defined between said inner wall surfaces of said heat generating chamber and said outer surfaces of said rotor element, for heat generation when a shearing stress is applied by the rotation of said rotor element;

wherein at least a part of said housing assembly, which defines said heat generating chamber, is made of a material of which a linear expansion coefficient is larger than that of a material of said rotor element.

2. The viscous fluid type heat generator of claim 1, wherein said housing assembly includes at least one partition plate arranged between said heat generating chamber and said heat receiving chamber, said partition plate having said inner wall surfaces of said heat generating chamber, and wherein said partition plate is made of said material of which said linear expansion coefficient is larger than that of said material of said rotor element.

3. The viscous fluid type heat generator of claim 1, wherein said housing assembly includes at least one partition plate arranged between said heat generating chamber and said heat receiving chamber, said partition plate having said inner wall surfaces of said heat generating chamber, and at least one housing body arranged outside of said partition plate to define said heat receiving chamber between said housing body and said partition plate, and wherein said partition plate and said housing body are made of said material of which said linear expansion coefficient is larger than that of said material of said rotor element.

4. The viscous fluid type heat generator of claim 1, wherein said material of said at least a part of said housing assembly is an aluminum material.

5. The viscous fluid type heat generator of claim 4, wherein said aluminum material is a die-cast aluminum having a linear expansion coefficient of $2.10\times10^{-5}$ (1/K).

6. The viscous fluid type heat generator of claim 1, wherein said material of said rotor element is a ferrous material.

7. The viscous fluid type heat generator of claim 6, wherein said ferrous material is a medium carbon steel having a linear expansion coefficient of $1.17\times10^{-5}$ (1/K).

* * * * *